US006198887B1

(12) United States Patent
Sato

(10) Patent No.: US 6,198,887 B1
(45) Date of Patent: Mar. 6, 2001

(54) TONER RESERVOIR WITH WIPER MECHANISM FOR WIPING SENSITIVE SURFACE OF TONER SENSOR

(75) Inventor: Tsutomu Sato, Tokyo (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/420,813

(22) Filed: Oct. 19, 1999

(30) Foreign Application Priority Data

Oct. 20, 1998 (JP) ..... 10-298147

(51) Int. Cl.[7] ..... G03G 21/00
(52) U.S. Cl. ..... 399/64
(58) Field of Search ..... 399/27, 61, 64, 399/65, 263

(56) References Cited

U.S. PATENT DOCUMENTS 5,035,198 * 7/1991 Niito ..... 399/27
5,214,475 * 5/1993 Ishii et al. ..... 399/27
5,508,795 * 4/1996 Kikuchi ..... 399/27
5,587,770 * 12/1996 Jo et al. ..... 399/27
5,682,574 * 10/1997 Oshida et al. ..... 399/64

* cited by examiner

*Primary Examiner*—Fred L. Braun
(74) *Attorney, Agent, or Firm*—Greenblum & Bernstein, P.L.C.

(57) ABSTRACT

A toner reservoir (22) for a toner dispenser unit (20) in a laser printer (10) is provided with a toner sensor (82) for detecting when the toner level in the toner reservoir (22) reduces to reach a minimum level, in order to inform the user of the necessity for toner replenishment. The toner sensor (82) has a sensitive surface (82*a*) exposed to the amount of toner in the toner reservoir (22) and is capable of detecting whether the sensitive surface (82*a*) is in contact with the amount of toner in the toner reservoir (22). The toner reservoir (22) is provided with a wiper mechanism (86) for the sensitive surface (82*a*) of the toner sensor (82). The wiper mechanism (86) includes a swing member (88) supported for swinging motion and a wiper element (90) mounted on the swing member (88). When the swing member (88) produces a stroke of swinging motion, the wiper element (90) moves across the sensitive surface (82*a*) while rubbing it, so as to wipe off any toner adhered on it. The swing member (88) is disposed in the toner reservoir (22) such that it produces a stroke of swinging motion when subject to action of the amount of toner in the toner reservoir (22).

23 Claims, 7 Drawing Sheets

TONER RESERVOIR WITH WIPER MECHANISM FOR WIPING SENSITIVE SURFACE OF TONER SENSOR

The present disclosure relates to subject matter contained in Japanese Patent Application No. Hei-10-298147 filed on Oct. 20, 1998, which is expressly incorporated herein by reference in its entirety.

BACKGROUND OF THE INVENTION

1. Field of the Invention

The present invention relates to a toner reservoir with a wiper mechanism for wiping a sensitive surface of a toner sensor provided for the toner reservoir.

2. Description of the Related Art

There are used various electrostatic image generating apparatus, including electrostatic copiers, laser printers, laser facsimile machines and the like. A typical electrostatic image generating apparatus uses a photosensitized medium, in the form of a drum or a belt, having a photosensitized surface made of photoconductive insulating material. A charging unit is used to place a uniform electrostatic charge over the photosensitized surface preparatory to imaging. Then, a desired light image is either projected by an optical system or drawn by a laser beam scanner on the photosensitized surface, to form an electrostatic latent image on the surface. Thereafter, the latent image is developed with a developing material, powdery material referred to in the art as toner, to form a powder image on that surface. The powder image is then transferred to and fixed onto a support surface, such as a surface of a sheet of paper.

For developing the latent image, such electrostatic image generating apparatus include a developer unit, which is designed to apply toner to the photosensitized surface having a latent image formed thereon, and a toner dispenser for dispensing toner into the developer unit. A typical toner dispenser comprises a dispenser roller cooperating with a toner reservoir, which may be also referred to as a toner hopper. The dispenser roller may comprise a foam roller, for example. During development process, toner is either continuously or periodically dispensed from the toner reservoir into the developer unit by means of the dispenser roller.

The toner reservoir reserves a supply of toner therein. After use of the apparatus for a certain length of time, such as several weeks or months, the supply of toner in the toner reservoir is depleted, so that the toner level in the toner reservoir reduces to reach a predetermined minimum level, above which the toner level has to be kept in order to ensure quality of images produced by the apparatus.

Many toner reservoirs used in recent electrostatic image generating apparatus are provided with a toner level sensor for sensing the toner level in the toner reservoir, so as to produce a low-toner-level alarm when it detects the toner level in the toner reservoir below the minimum level. This alarm is typically a visual alarm which may be provided by an indicator lamp, a visual display or the like. The user is informed thereby of the necessity for toner replenishment in the toner reservoir.

A typical toner level sensor uses a toner sensor having a sensitive surface. The sensitive surface is disposed in the toner reservoir at the height of the minimum level. The toner sensor detects whether its sensitive surface is in contact with the amount of toner reserved in the toner reservoir. If so, the toner level in the toner reservoir is above the minimum level. Otherwise, it is below the minimum level so that toner replenishment is required.

Because the toner sensor environment within the toner reservoir is dirty and severe due to existence of contaminous toner, an oscillatory sensor comprising a piezoelectric crystal element, which is highly immune to such environment, is preferably used together with associated electronic circuitry for supplying radio-frequency (RF) voltage to and measuring impedance of the piezoelectric crystal element. The piezoelectric crystal element has surfaces for oscillation to be induced by the applied RF voltage, one of which is exposed to serve as the sensitive surface of the toner sensor. Typically, the frequency of the RF voltage is selected to the natural resonance frequency of the piezoelectric crystal element. When the toner level in the toner reservoir is above the minimum level, the sensitive surface of the sensor is submerged in and thus in contact with the amount of toner reserved in the toner reservoir, which results in a shift of the resonance frequency of the piezoelectric crystal element from its natural resonance frequency. This in turn leads to a variation in its impedance, which is detected and used for determination whether the toner level is above the minimum level.

There arise a problem, however, from the inherent, cohesive nature of toner. After use of a toner reservoir for a certain long time, such as several months, there is often found a sticky layer r of cohered toner formed on the sensitive surface of the toner sensor. Further, the cohesion of toner can be promoted by the oscillatory pressure imposed by the oscillating sensitive surface of the toner sensor. Usually, the thickness of cohered toner layer formed on the sensitive surface of the sensor is small, but enough to shift the resonance frequency of the sensor to cause a substantial impedance variation, which may often result in a failure to detect a toner level below the minimum level.

One solution for this problem is a manual cleaning operation by the operator to wipe and clean the sensitive surface of the sensor; however, this is a highly dirty operation possibly creating a cloud of toner around the toner reservoir which is open in order to clean the sensitive surface of the sensor, and such a cloud of toner will contaminate parts of the machine using the toner reservoir as well as hands and clothes of the operator. The use of a motor-driven cleaning mechanism is another solution; however, such a mechanism is bulky and costly.

SUMMARY OF THE INVENTION

In view of the foregoing, it is an object of the present invention to provide a toner reservoir for reserving therein an amount of toner to be dispensed therefrom, the toner reservoir being provided with a toner sensor, the toner sensor having a sensitive surface exposed to the amount of toner in the toner reservoir and being capable of detecting whether the sensitive surface is in contact with the amount of toner in the toner reservoir, wherein the toner reservoir is provided with a wiper mechanism for wiping the sensitive surface of the toner sensor and the wiper mechanism may be simple in structure and may be fabricated at low cost.

In accordance with the present invention, there is provided a toner reservoir for reserving therein an amount of toner to be dispensed therefrom, the toner reservoir being provided with a toner sensor, the toner sensor having a sensitive surface exposed to the amount of toner in the toner reservoir and being capable of detecting whether the sensitive surface is in contact with the amount of toner in the toner reservoir. The toner reservoir is provided with a wiper mechanism for the sensitive surface. The wiper mechanism comprises (i) a swing member supported for swinging motion and (ii) a wiper element mounted on the swing member such that, when the swing member produces a stroke of swinging motion, the wiper element moves across the sensitive surface while rubbing the sensitive surface. Further, the swing member is disposed in the toner reservoir such that the swing member produces a stroke of swinging motion when subject to action of the amount of toner in the toner reservoir.

The swing member may preferably have a swinging end on which the wiper element is mounted.

The swing member may be preferably adapted to produce a stroke of swinging motion upon toner replenishment in the toner reservoir. Also, the swing member may be preferably adapted to produce a stroke of swinging motion upon toner depletion in the toner reservoir to a certain extent. The toner sensor may be preferably an oscillatory sensor comprising a piezoelectric crystal element.

In one aspect, the toner reservoir may be adapted for toner replenishment to be conducted by allowing an amount of toner to fall down. The swing member may include a toner pan adapted to receive a part of an amount of toner falling down upon toner replenishment. The swing member may be supported for swinging motion about a horizontal axis, such that the toner pan moves up and down between an upper position and a lower position when the swing member swings in opposite directions about the horizontal axis. In addition, the swing member may be balanced such that the toner pan is located in the upper position when toner in the toner reservoir is substantially depleted and that the toner pan makes a transition from the upper position to the lower position upon toner replenishment in the toner reservoir.

In another aspect, the toner reservoir is adapted for toner replenishment to be conducted by allowing an amount of toner to fall down, in which a part of the amount of toner falls down in a first region in the toner reservoir before another part of the amount of toner falls down in a second region in the toner reservoir. In such case, the swing member may include a horizontal shaft having a longitudinal axis extending horizontally, a toner pan fixedly connected to the horizontal shaft and a counterweight fixedly connected to the horizontal shaft. The toner pan may be adapted to receive a part of an amount of toner falling down upon toner replenishment. The swing member may be supported for swinging motion about a horizontal axis defined by the longitudinal axis of the horizontal shaft, such that the toner pan moves up and down between an upper position and a lower position when the swing member swings in opposite directions about the horizontal axis. The toner pan and the counterweight may be connected to the horizontal shaft on opposite sides of the horizontal shaft. The toner pan and the counterweight may be connected to the horizontal shaft at positions distant from each other in the longitudinal direction of the horizontal shaft, such that the toner pan and the counterweight are disposed in the first and second regions, respectively, in the toner reservoir. The swing member is balanced such that the toner pan is located in the upper position when toner in the toner reservoir is substantially depleted and that the toner pan makes a transition from the upper position to the lower position upon toner replenishment in the toner reservoir.

Further, relating to the second aspect, the toner reservoir may further comprise an elongated toner hopper housing and an elongated toner cartridge. The elongated toner hopper housing extends in a horizontal direction and defines a space for reserving toner therein, the toner hopper housing having an elongated top opening extending longitudinally of the toner hopper housing. The elongated toner cartridge has an amount of toner filled therein and is adapted for detachable attachment on the toner hopper housing with the bottom thereof on the top of the toner hopper housing, the toner cartridge having an elongated bottom opening extending longitudinally of the toner cartridge. The top opening of the toner hopper housing and the bottom opening of the toner cartridge is adapted to mate with each other when the toner cartridge is attached on the toner hopper housing so as to allow discharge of toner therethrough from the toner cartridge into the toner hopper housing. The toner cartridge has a strip of sealing tape closing the bottom opening, the sealing tape being adapted to be removed away to open the bottom opening after the toner cartridge is attached on the toner hopper housing. In addition, the horizontal shaft is disposed in the toner hopper housing so as to extend longitudinally of the toner hopper housing.

In either aspect, the toner pan may be further adapted to dump out any amount of toner remaining thereon when toner in the toner reservoir is depleted to a certain extent, and the swing member may be further balanced such that the toner pan makes a transition from the lower position to the upper position when the toner pan dumps out toner.

Further, the toner pan may comprise a substantially flat plate having a surface extending substantially parallel to the horizontal axis of swinging motion of the swing member, the toner pan may extend in a radial direction with respect to the horizontal axis and have a radially inner edge and a radially outer edge with respect to the horizontal axis, and the toner pan may be adapted to slant upward from the radially inner edge to the radially outer edge when the toner pan is located in the upper position and downward from the radially inner edge to the radially outer edge when the toner pan is located in the lower position.

Moreover, the toner pan may be further adapted to dump out any amount of toner remaining thereon from the radially inner edge when reaching the upper position. Also, the toner sensor may be disposed such that the sensitive surface extends generally vertically, and the wiper element may be mounted on the toner pan so as to be movable up and down together with the toner pan. Still further, the toner sensor may be preferably an oscillatory sensor comprising a piezoelectric crystal element.

Relating to the second aspect, the toner pan may be fixedly connected to the horizontal shaft through at least one rod-like connector member, with a gap formed between the horizontal shaft and the radially inner edge of the toner pan, such that the gap allows toner to pass therethrough so as to facilitate dumping out toner from the radially inner edge of the toner pan. Also, the counterweight may be fixedly connected to the horizontal shaft through at least one rod-like connector member, with a gap formed between the horizontal shaft and the counterweight, such that the gap allows toner to pass therethrough so as to avoid substantial deposit of toner on the swing member at a region between the rod and the counterweight, and the counterweight may be so shaped as to avoid substantial deposit of toner thereon.

BRIEF DESCRIPTION OF THE DRAWINGS

The above and other objects, features and advantages of the present invention will be apparent from the following detailed description of a preferred embodiment thereof, reference being made to the accompanying drawings, in which.

DETAILED DESCRIPTION OF A PREFERRED EMBODIMENT

Referring now to the accompanying drawings, a preferred embodiment of the present invention will be described in detail.

Figure 1:
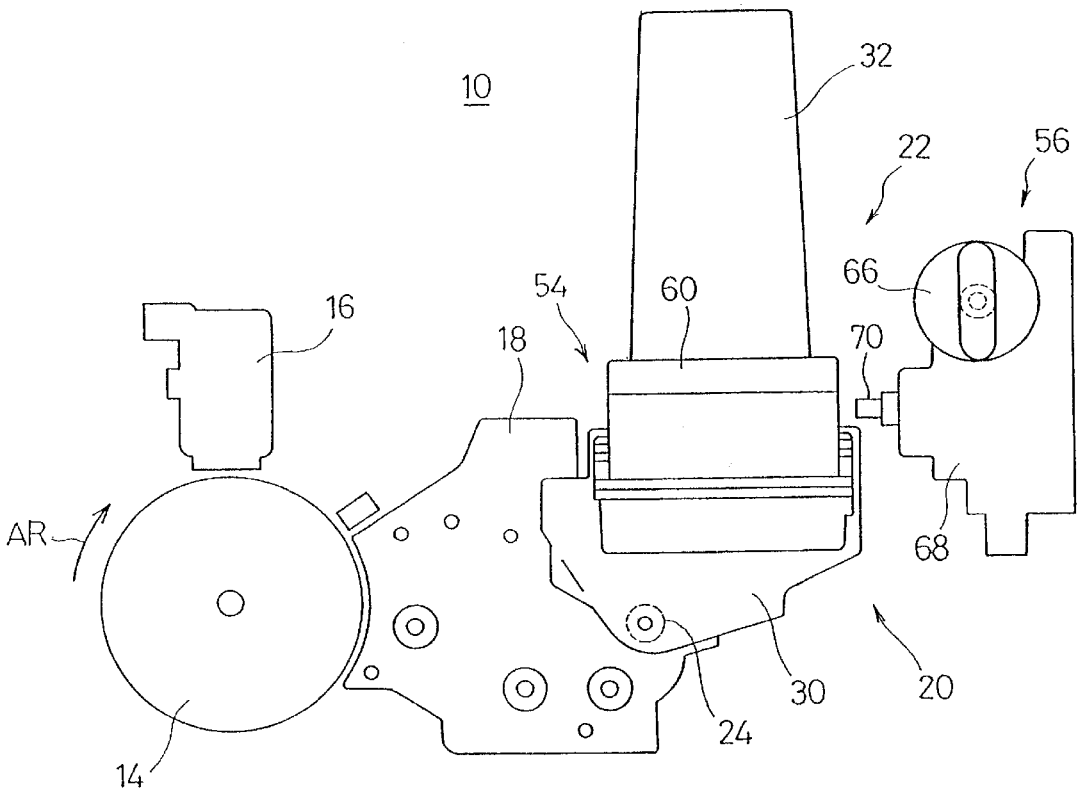
FIG. 1 is a schematic showing a relevant part of an electrostatic image generating apparatus using a toner reservoir according to a preferred embodiment of the present invention, which comprises a toner cartridge and a toner hopper housing and is provided with a toner sensor and a wiper mechanism for a sensitive surface of the toner sensor.

FIG. 1 shows a relevant part of an electrostatic image generating apparatus using a toner reservoir according to a preferred embodiment of the present invention. The apparatus, generally designated by reference numeral 10, comprises a laser printer. Among various elements and components of the laser printer 10, FIG. 1 only shows those which provide the functions related to the development process of electrostatic latent image, while the other elements and components, which may be any conventional ones, are omitted for simplicity. In particular, the laser printer 10 has a photosensitized drum 14, the outer periphery of which is coated with a suitable photoconductive material. The drum 14 is suitably journaled for rotation within a machine frame (not shown) by means of a shaft and is rotated in the direction indicated by arrow AR by means of a suitable drive mechanism (not shown). The laser printer 10 further comprises a charging unit 16 for placing a uniform electrostatic charge over the photoconductive surface of the drum 14 preparatory to imaging.

Onto the charged photoconductive surface, a desired image (which may be a text image or a picture image) is drawn by means of an image drawing unit (not shown) utilizing a laser beam scanner for projecting a laser beam to be focused on the surface. Any regions exposed to the laser beam have the charge dissipated, so that an electrostatic latent image is created on the drum surface.

The laser printer 10 further comprises a developer unit 18 and a toner dispenser unit 20. The developer unit 18 serves to develop the electrostatic latent image with a developing material, powdery material referred to in the art as toner, so as to form a powder image corresponding to the latent image. The developer unit 18 comprises a toner applicator for applying toner to the charged regions of the drum surface to render the latent image visible. The toner applicator may be any conventional means for providing the required function. For example, it may comprise any kind of magnetic brushes known in the art.

The toner dispenser unit 20 comprises a toner reservoir 22 for reserving a supply of toner therein and a dispenser roller 24 for dispensing toner from the toner reservoir 22 into the developer unit 18 during development process. The dispenser roller 24 is housed within the toner reservoir 22 and disposed near the bottom of the toner reservoir 22. The dispenser roller 24 comprises a shaft and a cylindrical member made of a foam material and fitted over the shaft. The dispenser roller 24 is journaled for rotation about its axis and so disposed as to extend in a horizontal direction parallel to the photosensitized drum 14 of the developer unit 18. The dispenser roller 24 has its effective length substantially equal to the effective length of the photosensitized drum 14.

The toner reservoir 22 comprises a horizontally-extending, elongated container consisting of upper and lower vessels separable from each other. The lower vessel comprises a toner hopper housing 30 elongated in shape and extending in a horizontal direction, while the upper vessel comprises a disposable toner cartridge 32 elongated in shape and adapted for detachable attachment on the toner hopper housing 30 with its bottom on the top of the toner hopper housing 30.

Briefly, the toner cartridge 32 is designed for quick attachment/detachment on/from the toner hopper housing 30. Before use, the toner cartridge 32 is filled with an amount of toner to be replenished in the toner reservoir 22. Once attached, the toner cartridge 32 is kept on the toner hopper housing 30 until a new toner cartridge is replaced for it. Accordingly, the toner hopper housing 30 and the toner cartridge 32 together form the container serving as the toner reservoir 22, within which the dispenser roller 24 is housed and the supply of toner is reserved. The toner hopper housing 30 has a double-bottom structure comprising an inner bottom wall 34 and an outer bottom wall 36, as described in more detail later.

Figure 2:
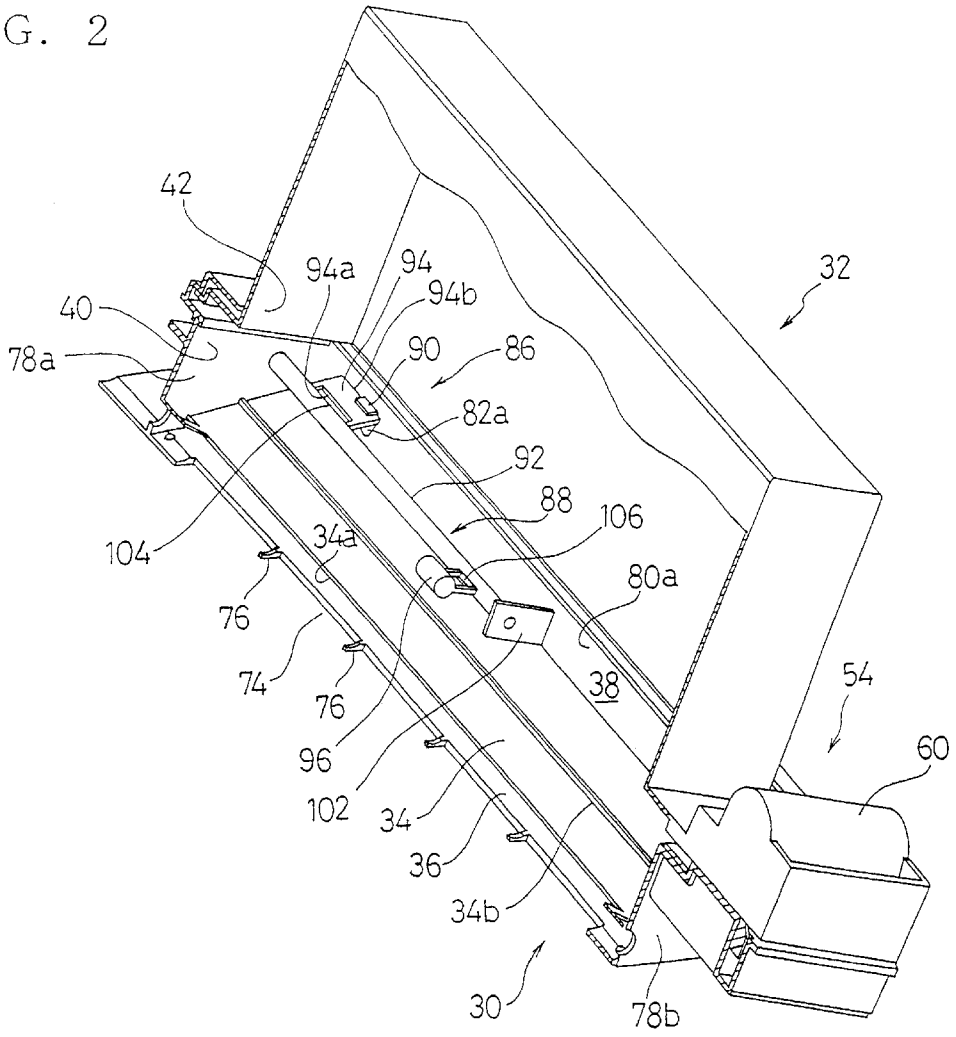
FIG. 2 is a perspective view of the toner cartridge attached on the toner hopper housing, partially cut away generally along a longitudinal vertical plane.
Figure 3:
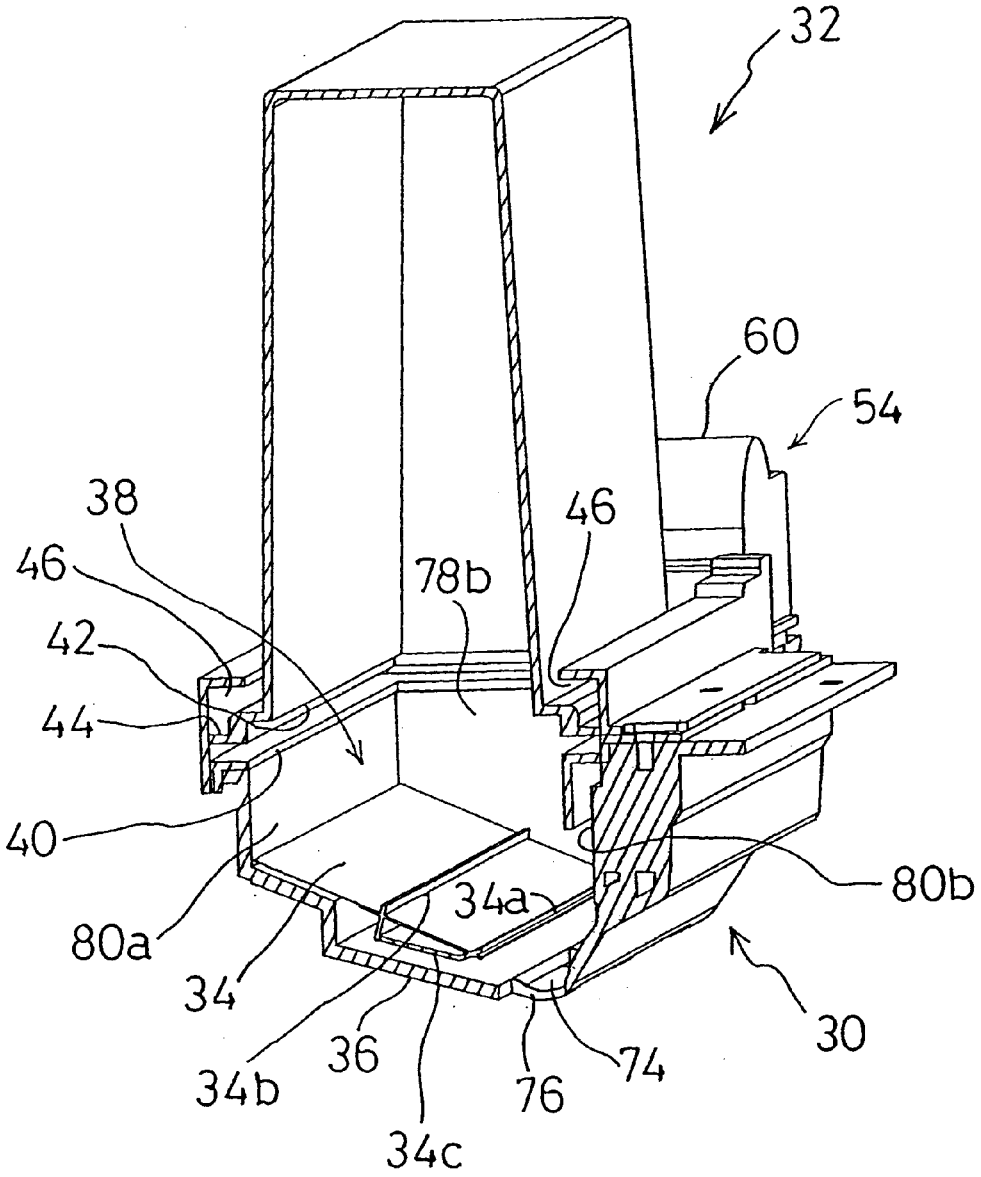
FIG. 3 is a perspective view of the toner cartridge attached on the toner hopper housing, partially cut away along a cross-cutting plane.

More specifically, as shown in FIGS. 2 and 3, the toner hopper housing 30 is a horizontally-extending, elongated vessel having its top substantially fully open. Accordingly, the toner hopper housing 30 defines a space 38 for reserving toner therein and has an elongated top opening 40. The top opening 40 is generally rectangular in shape and extends longitudinally of the toner hopper housing 30. The top opening 40 extends along and just above the dispenser roller 24 so as to substantially cover the effective length of the dispenser roller 24.

The toner cartridge 32 has a casing, which is an elongated, box-shaped vessel having its bottom substantially fully open. Thus, the toner cartridge 32 has an elongated bottom opening 42, which is generally rectangular in shape and extends longitudinally of the toner cartridge 32.

The top opening 40 of the toner hopper housing 30 and the bottom opening 42 of the toner cartridge 32 are similar to each other in shape and size, and are adapted to mate with each other when the toner cartridge 32 is attached on the toner hopper housing 30, so as to allow discharge of toner therethrough from the toner cartridge 32 into the toner hopper housing 30.

Figure 4:
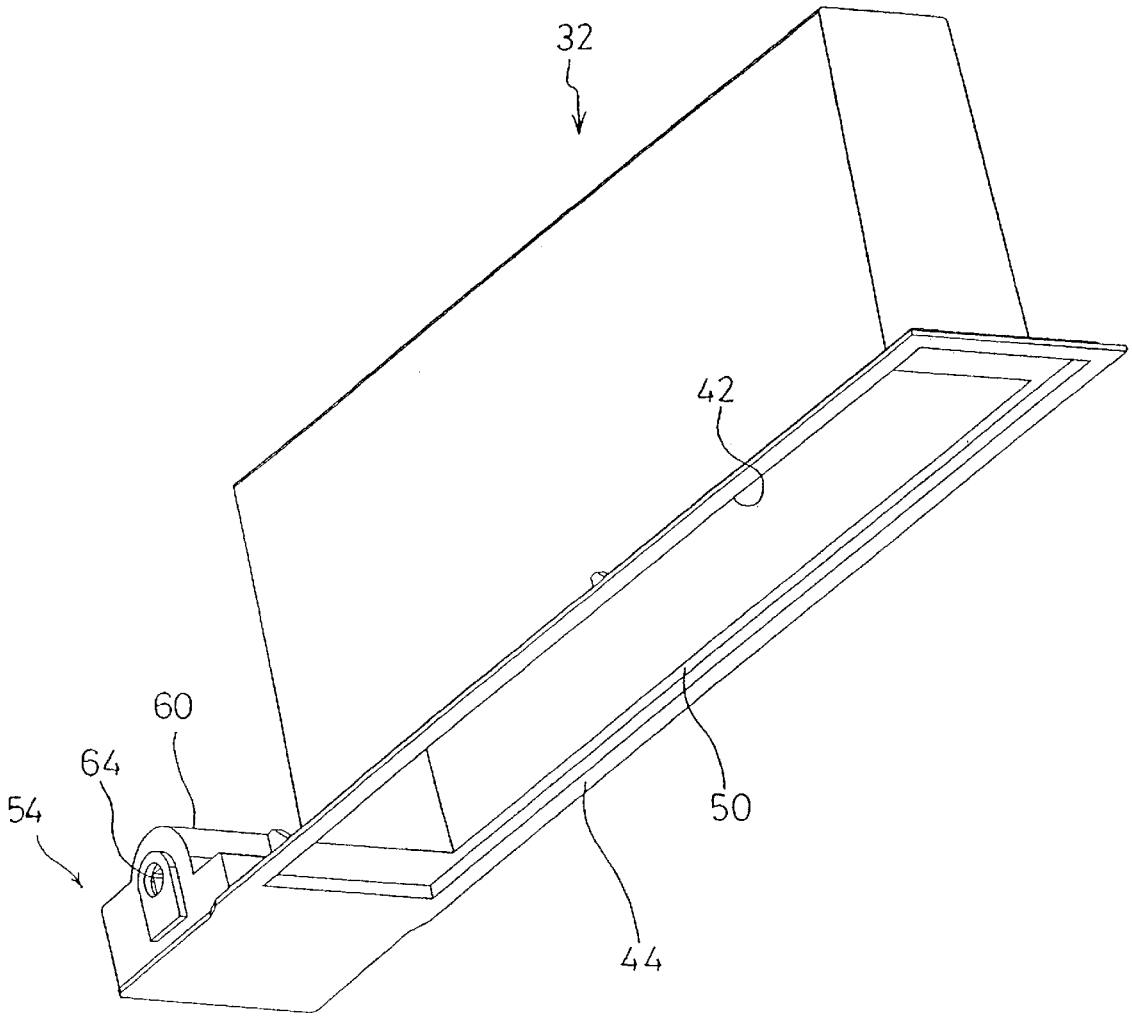
FIG. 4 is a perspective view of an empty casing of the toner cartridge after removal of a strip of sealing tape.

As best seen from FIG. 4, the casing of the toner cartridge 32 has a bottom flange plate 44 extending outwardly from the edges of the bottom opening 42. The bottom flange plate 44 has a rectangular outline with a pair of end edges and a pair of side edges. In correspondence thereto, the top opening 40 of the toner hopper housing 30 has four edges including a pair of end edges and a pair of side edges, among which one end edge and the pair of side edges are provided with respective receptacle slots 46 for receiving the corresponding edges of the bottom flange plate 44 of the toner cartridge 32.

With this structure, the opposite side edges of the bottom flange plate 44 of the toner cartridge 32 can be slid into the corresponding receptacle slots 46 provided on the opposite side edges of the toner hopper housing 30. With the front end edge of the bottom flange plate 44 of the toner cartridge 32 being received in the corresponding end receptacle slot 46 of the toner hopper housing 30, the toner cartridge 32 is positioned relative to the toner hopper housing 30 and retained there by means of suitable click stops (not shown) provided between them. By virtue of this, the attachment/detachment of the toner cartridge 32 on/from the toner hopper housing 30 may be accomplished in a quick manner.

As shown in FIG. 4, the bottom flange plate 44 of the toner cartridge 32 has a retracted surface 50 (retracted from the bottom surface of the toner cartridge 32) defining the peripheral area of the bottom opening 42. The retracted surface 50 provides a sealing surface. After a measured amount of toner is filled in the toner cartridge 32, a strip of flexible, removable, sealing tape 52 (schematically shown in FIGS. 6A to 6B) is adhered to the sealing surface 50 so as to sealingly close the bottom opening 42 of the toner cartridge 32. The sealing tape 52 is made of a suitable plastic film material which can be strippably adhered onto any smooth surface by heating. The sealing tape 52 is adapted to be removed away to open the bottom opening 42 after the toner cartridge 32 is attached on the toner hopper housing 30

Figure 6A:
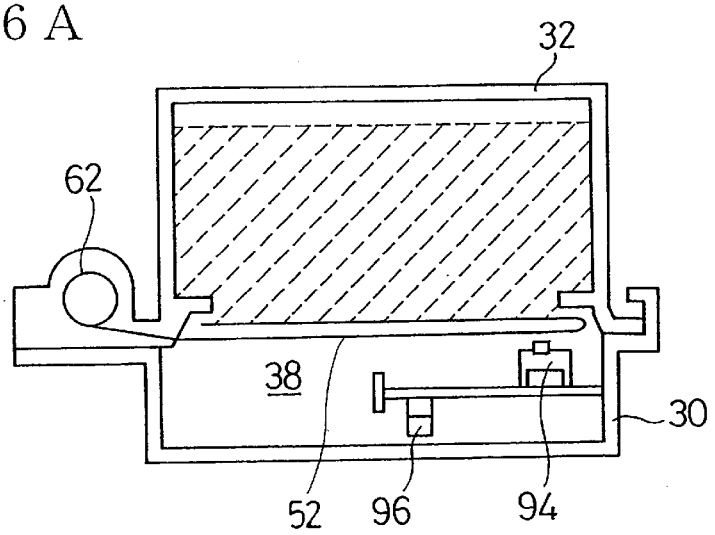
FIGS. 6A through 6C are schematics illustrating flow of toner upon toner replenishment in the toner reservoir.

For facilitating removal of the sealing tape 52, i.e., stripping it from the sealing surface 50, the toner cartridge 32 has a tape take-up reel mechanism 54 provided on the bottom flange plate 44 and at one end of the toner cartridge 32. For convenience, this end of the toner cartridge 32 is referred to hereinafter as the "second end", while the other end of the toner cartridge 32 as the "first end". Before removal, as shown in FIG. 6A, the strip of sealing tape 52 has its one end terminating at the end edge of the bottom opening 42 at the second end of the toner cartridge 32 (referred to as the "second end edge of the bottom opening 42".) The sealing tape 52 extends therefrom toward the opposite end edge of the bottom opening 42 at the first end of the toner cartridge 32 (referred to as the "first end edge of the bottom opening 42"), and thence, turns around to return toward the second end of the toner cartridge 32 and enter the tape take-up reel mechanism 54 through a slit formed in the bottom flange plate 44.

Here, the portion of the strip of sealing tape 52 that extends from the second end edge to the first end edge of the bottom opening 42 is referred to as the first portion of the sealing tape 52, while the following portion that returns from the first end edge of the bottom opening 42 to the tape take-up reel mechanism 54 as the second portion of the sealing tape 52. Only the first portion of the sealing tape 52 is adhered by heating to the sealing surface 50 of the toner cartridge 32, while the second portion is not adhered to the sealing surface 50 at all. The second portion is just utilized to strip the first portion of the sealing tape 52 off the sealing surface 50 by means of the sealing tape take-up reel mechanism 54.

The laser printer 10 is provided with a sealing tape remover handle mechanism 56 (shown in FIGS. 1 and. 5) for driving the sealing tape take-up reel mechanism 54 of the toner cartridge 32. The sealing tape take-up reel mechanism 54 includes a reel housing 60 and a tape take-up reel 62 housed therein. The reel housing 60 is formed as an integral part of the casing of the toner cartridge 32. The reel 62 is supported by the reel housing 60 and has a rectangular socket hole 64 formed in one end surface thereof. The socket hole 64 is exposed through an opening formed in the reel housing 60 so as to be accessible to the sealing tape remover handle mechanism 56.

Figure 5:
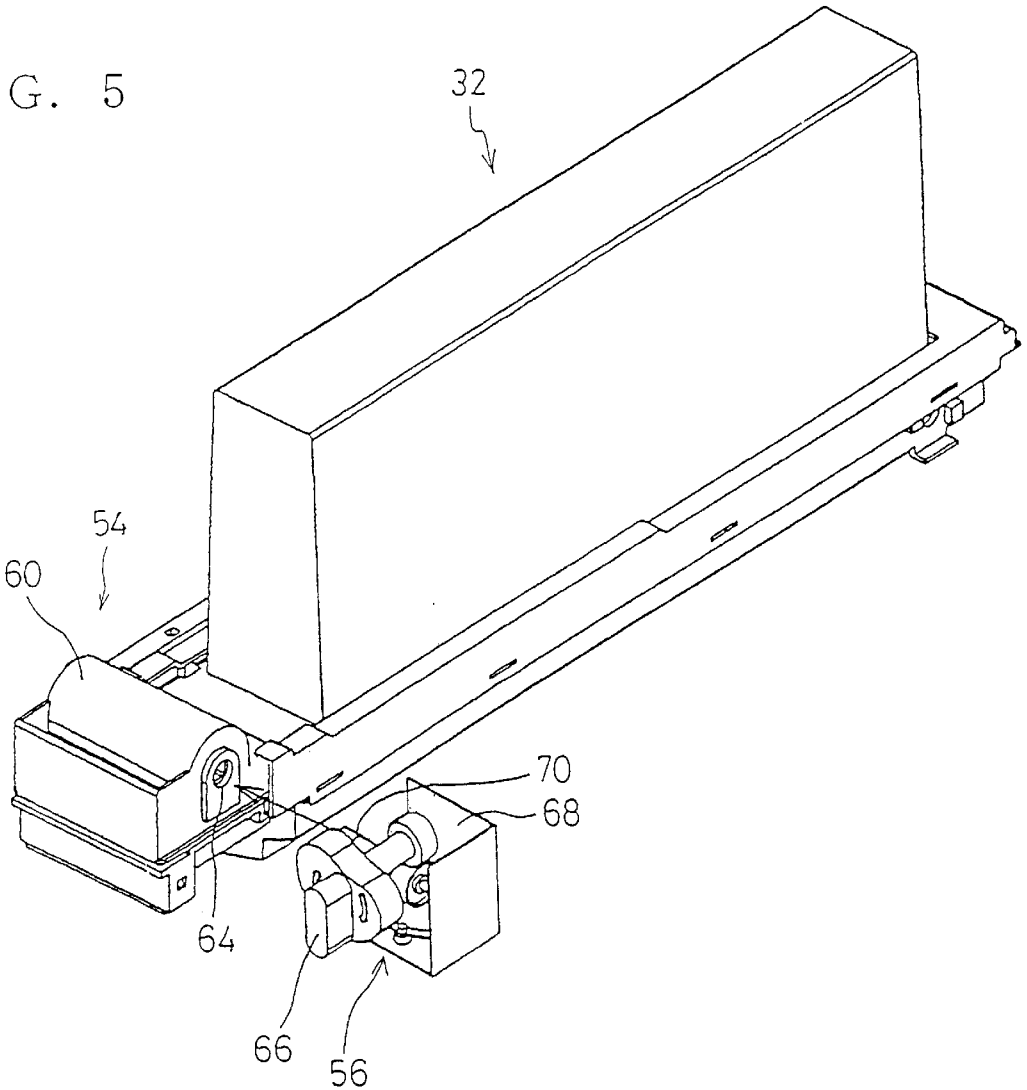
FIG. 5 is a perspective view of the toner cartridge attached on the toner hopper housing together with a tape remover handle mechanism.

As shown in FIGS. 1 and 5, the handle mechanism 56 comprises a rotary handle 66 and a connection mechanism 68 for operatively connecting the rotary handle 66 to the reel 62 of the sealing tape take-up reel mechanism 54. The connection mechanism 68 includes a drive shaft 70, which is operatively connected to and rotated by the rotary handle 66. Also, the drive shaft 70 is capable of longitudinal movement between protruded and retracted positions. The drive shaft 70 has its tip end formed in a shape for fitting into the rectangular socket hole 64 of the reel 62. This fitting connection between the drive shaft 70 and the reel 62 occurs when the former is in its protruded position, so as to allow torque transmission between them.

Upon replacement of the toner cartridge 32 with a new one, the drive shaft 70 is moved into the retracted position by a linkage (not shown). After installation of the new toner cartridge on the toner hopper housing 30, the drive shaft 70 is moved by the linkage to the protruded position and the tip end thereof is fitted into the socket hole 64 of the reel 62. Then, the user can rotate the rotary handle 66 to strip and remove the sealing tape 52 off the sealing surface 50 to open the bottom opening 42, so that the amount of toner in the toner cartridge 32 is allowed to fall down into the toner hopper housing 30 to complete toner replenishment in the toner reservoir 22. Accordingly, when toner is replenished in the toner reservoir 22, the sealing tape 52 is removed away along the length of the elongated bottom opening 42, i.e., from one longitudinal end of the bottom opening 42 to the other longitudinal end of the bottom opening 42.

The toner hopper housing 30 will be described in more detail hereinafter. The toner hopper housing 30 has a pair of end walls 78*a* and 78*b* (FIG. 2) and a pair of side walls 80*a* and 80*b* (FIG. 3). In addition, as described above, the toner hopper housing 30 has the double-bottom structure comprising the inner bottom wall 34 and the outer bottom wall 36.

The outer bottom wall 36 is formed as an integral part of the toner hopper housing 30 itself. The outer bottom wall 36 has a toner dispensing slit 74 formed therein, which extends along and just under the dispenser roller 24 to cover the entire length of the dispenser roller 24, so that any toner falling down off the surface of the dispenser roller 24 may pass through the slit 74 to exit the toner hopper housing 30 into the developer unit 18. The toner hopper housing 30 also has a plurality of bridges 76 connecting opposite edges of the slit 74 for reinforcement of the toner hopper housing 30.

The inner bottom wall 34 comprises a flat, thin, generally rectangular plate extending between the end walls 78*a* and 78*b* and slanting down with a shallow slant from one of the side walls, 80*a,* of the toner hopper housing 30 toward the dispenser roller 24 to terminate at a lip edge 34*a*. The lip edge 34*a* of the inner bottom wall 34 extends along and covers the entire length of the dispenser roller 24, and is kept in engagement with the cylindrical surface of the dispenser roller 24.

The inner bottom wall 34 has a longitudinal stiffener rib 34*b,* as well as a lip reinforcement strip 34*c* (FIG. 3) extending along the lip edge 34*a*. The lip reinforcement strip 34*c* prevents any substantial deformation of the lip edge 34*a,* which otherwise could be caused by the force acting from the dispenser roller 24 to the lip edge 34*a*. The inner bottom wall 34 may be vibrated by means of a suitable vibrator unit (not shown) in order to convey any toner thereon down toward the dispenser roller 24.

With the structure described above, the outer bottom wall 36 extends below the inner bottom wall 34 to provide protection for the inner bottom wall 34 and the dispenser roller 24, while the combination of the inner bottom wall 34 and the dispenser roller 24 provides the essential function of the bottom, i.e., the combination serves to retain the supply of toner in the toner reservoir 22 by preventing it from freely flowing down out of the toner reservoir 22. By cooperation of the inner bottom wall 34 with the dispenser roller 24, only a controlled dose of toner per unit of time, which depends on the rotational speed of the dispenser roller 24, is caused to pass through the area of engagement between the dispenser roller 24 and the lip edge 34*a* of the inner bottom wall 34 and fall down through the toner dispensing slit 74 formed in the outer bottom wall 36 into the developer unit 18. This manner of dispensing toner is based on the adhesive nature of toner to the foam material of the dispenser roller 24, as is well known in the art.

Figure 7:
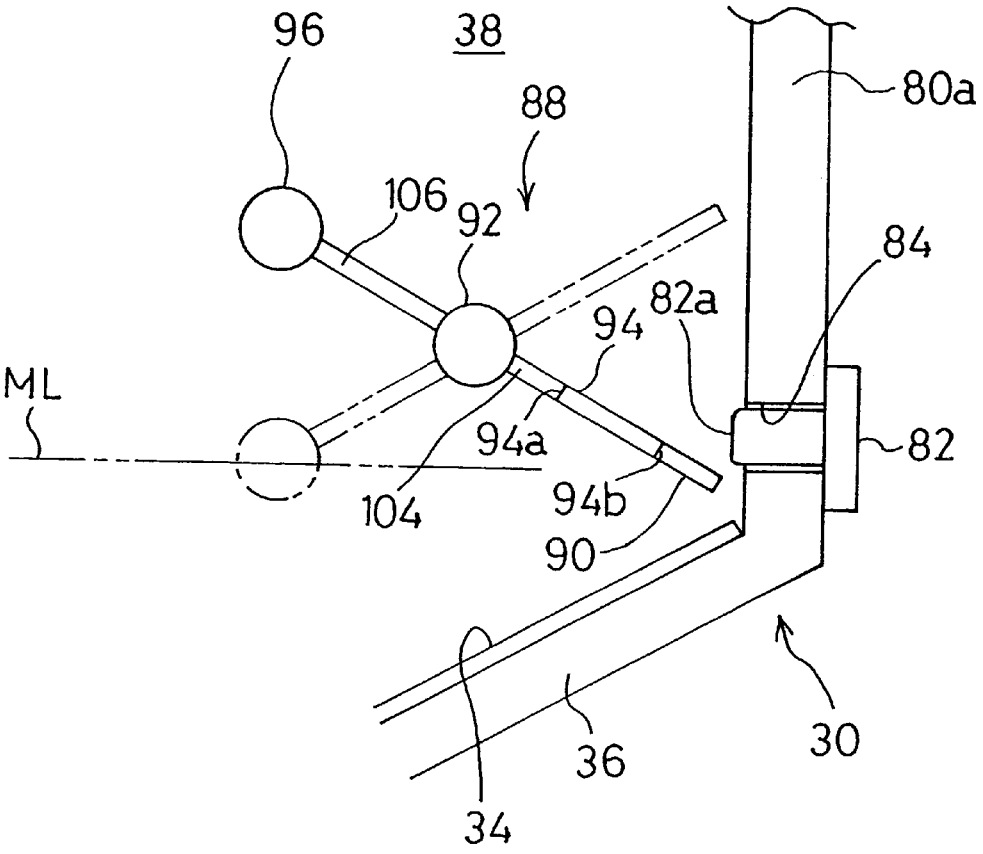
FIG. 7 is a schematic illustrating the operation of the wiper mechanism.

As shown in FIGS. 2 and 7, the toner reservoir 22 is provided with a toner sensor 82, which is used to detect and indicate to the user when the toner level in the toner reservoir 22 has reduced to reach a predetermined minimum level, above which the toner level has to be kept in order to ensure quality of images produced by the laser printer 10. The toner sensor 82 has a sensitive surface 82*a* exposed to the amount of toner in the toner reservoir 22. The sensitive surface 82*a* is disposed in the toner reservoir 22 at the height of the minimum level ML, as shown in FIG. 7. The toner sensor 82 is capable of detecting whether the sensitive surface 82*a* is in contact with the amount of toner in the toner reservoir 22. If so, the toner level in the toner reservoir 22 is above the minimum level ML. Otherwise, it is below the minimum level ML so that toner replenishment is required.

More particularly, the toner sensor 82 is an oscillatory sensor comprising a piezoelectric crystal element, which is highly durable even in the sensor environment within the toner reservoir 22 which is so dirty and severe due to existence of toner. The piezoelectric crystal element is electrically connected with associated electronic circuitry (not shown) for supplying radio-frequency (RF) voltage to and measuring impedance of the piezoelectric crystal element. The piezoelectric crystal element has surfaces for oscillation to be induced by the applied RF voltage, one of which is exposed to serve as the sensitive surface 82*a* of the toner sensor 82. The frequency of the RF voltage is selected to the natural resonance frequency of the piezoelectric crystal element. When the toner level in the toner reservoir 22 is above the minimum level ML, the sensitive surface 82*a* of the sensor 82 is submerged in and thus in contact with the amount of toner reserved in the toner reservoir 22, which results in a shift of the resonance frequency of the piezoelectric crystal element from its natural resonance frequency. This in turn leads to a variation in its impedance, which is detected and used for determination whether the toner level is above the minimum level ML. Of course, various other types of sensors may be also used as the toner sensor for the present invention.

For convenience, we refer hereinafter one of the longitudinal ends of elongated space 38 in the toner hopper housing 30 that corresponds to the first end of the toner cartridge 32 as the "first end of the space 38", while the other of the longitudinal ends of the space 38 as the "second end of the space 38". Using this terminology, the toner hopper housing 30 has a through hole 84 (FIG. 7) formed in one of the side walls, 78*a,* adjacent the first end of the space 38, and at the height of the minimum toner level ML. The toner sensor 82 is fitted in the through hole 84, such that its sensitive surface 82*a* may be exposed to the amount of toner in the space 38, as described above.

In order to prevent formation of a layer of cohered toner on the sensitive surface 82*a* of the toner sensor 82, the toner reservoir 22 is further provided with a wiper mechanism 86 for wiping the sensitive surface 82*a* of the toner sensor 82. Such a layer of cohered toner otherwise could be formed on the sensitive surface 82*a* due to the inherent, cohesive nature of toner after use of the toner reservoir 22 for a certain long time, such as several months, which may result in a failure to detect a toner level below the minimum level.

The wiper mechanism 86 is disposed in the toner hopper housing 30, and thus in the toner reservoir 22. The wiper mechanism 86 comprises a swing member 88 and a wiper element 90 mounted on the swing member 88. The swing member 88 is supported for swinging motion about a horizontal axis and has a swinging end on which the wiper element 90 is mounted. When the swing member 88 produces a stroke of swinging motion, the wiper element 90 moves across the sensitive surface 82*a* of the toner sensor 82 while rubbing the sensitive surface 82*a,* so as to wipe off any toner adhered on the sensitive surface 82*a*.

Specifically, the swing member 88 comprises a horizontal shaft 92 having a longitudinal axis extending horizontally, a toner pan 94 fixedly connected to the horizontal shaft 92 and a counterweight 96 fixedly connected to the horizontal shaft 92. The horizontal shaft 92 extends longitudinally of the toner hopper housing 30 and is supported at opposite ends by one of the end walls, 80*a,* of the toner hopper housing 30 and a support plate 102 provided in the toner hopper housing 30. The horizontal shaft 92 is supported for rotation about its longitudinal axis and within a predefined rotational range delimited by means of suitable stops (not shown) engageable with the swing member 88. With this arrangement, the swing member 88 is supported for swinging motion about a horizontal axis, which is defined by the longitudinal axis of the horizontal shaft 92, and within a predefined swing range corresponding to the rotational range of the horizontal shaft 92.

As described above, toner replenishment in the toner reservoir 22 is conducted by removing away the sealing tape 52 to open the bottom opening 42 of the toner cartridge 32 so as to allow the amount of toner in the toner cartridge 32 to fall down in the toner hopper housing 30. The toner pan 94 is adapted to receive a part of an amount of toner falling down upon toner replenishment. The toner pan 94 is further adapted to dump out any amount of toner remaining thereon when toner in the toner reservoir 22 is depleted to a certain extent. These functions of the toner pan 94 will become apparent from the following detailed descriptions of the toner pan 94 and the counterweight 96 .

More specifically, the toner pan 94 comprises a substantially flat, rectangular plate having opposite surfaces extending substantially parallel to the horizontal axis of swinging motion of the swing member 88. Accordingly, the toner pan 94 extends in a radial direction with respect to the horizontal axis. As shown in FIG. 7, when the swing member 88 swings in opposite directions about the horizontal axis and within the predefined swing range, the toner pan 94 moves up and down between an upper position (shown by imaginary lines in FIG. 7) and a lower position (shown by solid lines in FIG. 7) corresponding to the limits of the swing range. The toner pan 94 has a radially inner edge 94*a* and a radially outer edge 94*b* with respect to the horizontal axis, and is adapted to slant upward from the radially inner edge 94*a* to the radially outer edge 94*b* when the toner pan 94 is located in the upper position and downward from the radially inner edge 94*a* to the radially outer edge 94*b* when the toner pan 94 is located in the lower position. The slant of the toner pan 94 in these positions provides the toner-dumping-out function of the toner pan 94.

In addition, the toner pan 94 is fixedly connected to the horizontal shaft through a pair of rod-like connector members, with a gap 104 formed between the horizontal shaft 92 and the radially inner edge 94*a* of the toner pan 94. This gap 104 allows toner to pass therethrough so as to facilitate dumping out toner from the radially inner edge 94*a* of the toner pan 94.

The counterweight 96 is used to establish desired balance of the swing member 88. The counterweight 96 is fixedly connected to the horizontal shaft 92 through a pair of rod-like connector members, with a gap 106 formed between the horizontal shaft 92 and the counterweight 96. This gap 106 allows toner to pass therethrough so as to avoid substantial deposit of toner on the swing member 88 at a region between the horizontal shaft 92 and the counterweight 96. Further, the counterweight 96 is so shaped as to avoid substantial deposit of toner on itself. Accordingly, in the embodiment shown, the counterweight 96 is of a cylindrical shape having its axis extending horizontally. The counterweight 96 may be formed in any other shapes, as long as it is effective for avoiding substantial deposit of toner thereon.

The toner pan 94 and the counterweight 96 are connected to the horizontal shaft 92 on opposite sides of the horizontal shaft 92. In addition, the toner pan 94 and the counterweight 96 are connected to the horizontal shaft 92 at positions distant from each other in the longitudinal direction of the horizontal shaft 92. The separation of the toner pan 94 and the counter weight 96 in the longitudinal direction of the horizontal shaft 92 is advantageous for the following reasons. For convenience, the region of the toner pan 94 in the toner reservoir 22, which corresponds to the first end of the space 38 in the toner hopper housing 30, is referred to as the first region in the toner reservoir 22. Also, the region of the counterweight 96 in the toner reservoir 22, which corresponds to the longitudinal-center area of the space 38 in the toner hopper housing 30, is referred to as the second region in the toner reservoir 22. As described above, upon toner replenishment in the toner reservoir 22, the sealing tape 52 of the toner cartridge 32 is removed away along the length of the elongated bottom opening 42, i.e., from one longitudinal end of the bottom opening to the other longitudinal end of the bottom opening 42, so as to allow the amount of toner in the toner cartridge 32 to fall down. As the result, such toner replenishment is conducted by allowing an amount of toner to fall down, in which a part of the amount of toner falls down in the first region in the toner reservoir 22 before another part of the amount of toner falls down in the second region in the toner reservoir 22. This means that upon replenishment toner falls down on the toner pan 94 first and then on the counterweight 96 since the toner pan 94 and the counterweight 96 are disposed in the first and second regions in the toner reservoir 22, respectively. Therefore, when toner starts falling down onto the counterweight 96, the toner pan 94 has been already done its downward transition from the upper position to the lower position and has been submerged deep in the amount of replenished toner, so that the deposition of toner on the counterweight 96, if any, can do no harm to the downward transition of the toner pan 94.

For desired operations of the wiper mechanism 86, the balance of the swing member 88 is established as follows. First, the swing member 88 is balanced such that the toner pan 94 is located in the upper position (and thus the counterweight 96 is lowered) when toner in the toner reservoir 22 is substantially depleted and thereby the toner pan 94 is empty of toner. Second, it is balanced such that the toner pan 94 makes a downward transition from the upper position to the lower position (and thus the counterweight 96 pops up) upon toner replenishment in the toner reservoir 22, by which the toner pan 94 receives a certain amount of toner and thereby bears the weight of the received amount of toner. Third, it is balanced such that the toner pan 94 makes an upward transition from the lower position to the upper position (and thus the counterweight 96 pops down) when the toner pan 94 dumps out toner, which occurs when toner in the toner reservoir 22 is depleted to a certain extent, as described above.

Accordingly, the swing member 88 produces a stroke of swinging motion when subject to action of the amount of toner in the toner reservoir 22, without being driven by any external power source. It may produce a stroke of swinging motion upon toner replenishment in the toner reservoir 22, as well as upon toner depletion in the toner reservoir 22 to a certain extent. (Here, the term "to a certain extent" implies that it is not the complete depletion.)

The wiper element 90 is mounted on the radially outer edge 94*b* of the toner pan 94. When the swing member 88 produces a stroke of swinging motion, the wiper element 90 moves across the sensitive surface 82*a* of the toner sensor 82 to wipe off any toner adhered on the sensitive surface 82*a,* as described above. The wiper element 90 may comprise a strip of flexible film material or a block of soft foam material. It may be also made from any other materials suitable for wiping or scraping off any toner adhered or stuck on the sensitive surface 82*a* of the toner sensor 82.

Since the wiper element 90 is mounted on the outer edge 94*b* of the toner pan 94, it moves up and down together with the toner pan 94. This is convenient for wiping the sensitive surface 82*a* of the toner sensor 82 because the toner sensor 82 is disposed such that its sensitive surface 82*a* extends generally vertically, as shown in FIG. 7. In the case where the toner sensor is disposed in a different orientation, the wiper element may be mounted on any suitable swinging end of the swing member for wiping the sensitive surface of such toner sensor.

Figure 6B:
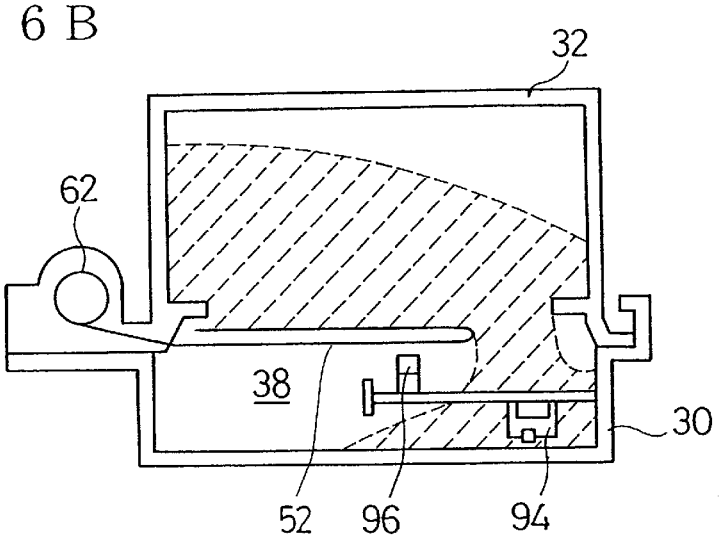
Figure 6C:
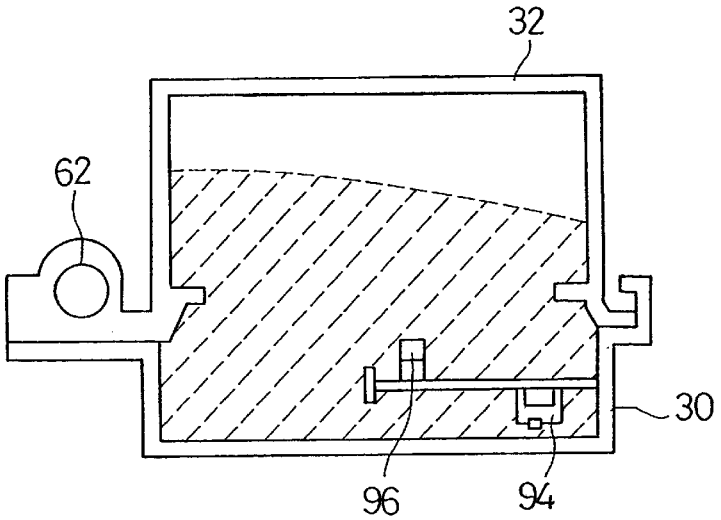

In operation, when the toner sensor 82 has detected a toner level in the toner reservoir 22 below the minimum level ML, an indicator lamp (not shown) informs the user of the necessity for toner replenishment. At this point of time, the toner pan 94 is located in the upper position and is empty of toner. The user then replaces the used toner cartridge 32 with a new one (FIG. 6A), and starts stripping the sealing tape 52 of the new toner cartridge 32. The amount of toner in the toner cartridge 32 starts falling down at the first end of the toner reservoir 22, at which the toner pan 94 is disposed, so that the amount of toner falls down first onto the toner pan 94, with the result that the toner pan 94 moves down into the lower position and is submerged under the layer of fallen toner (FIG. 6B). During this downward transition of the toner pan 94 from the upper position to the lower position, the wiper element 90 mounted on the toner pan 94 wipes the sensitive surface 82*a* of the toner sensor 82 to scrape off any toner adhered thereon. As the stripping of the sealing tape 52 is continued, the fall of toner moves along the length of the toner reservoir 22, so that the counterweight 96 is then submerged under the layer of fallen toner. When the sealing tape 52 is completely removed away, the toner replenishment operation is accomplished (FIG. 6C).

As toner in the toner reservoir 22 is dispensed into the developer unit 18 during use of the laser printer 10, the toner level in the toner reservoir 22 lowers and thereby the weight of toner acting on the toner pan 94 reduces. When toner in the toner reservoir 22 has been depleted to a certain extent, the toner pan 94 starts moving upward, by which any amount of toner then remaining on the toner pan 94 is dumped out of the toner pan 94 from the radially outer edge 94*b* thereof. By virtue of this dumping out, the upward movement of the toner pan 94 is accelerated, so that it pops up to the upper position. If toner on the toner pan 94 is not completely dumped out from the radially outer edge 94*b* when the toner pan 94 starts popping up from the lower position, then the residual toner will be dumped out from the radially inner edge 94*a* when the toner pan 94 is reaching the upper position. During this upward transition of the toner pan 94 from the lower position to the upper position, the wiper element 90 mounted on the toner pan 94 wipes the sensitive surface 82*a* of the toner sensor 82 to scrape off any toner adhered thereon.

As understood from the above, in this embodiment, the sensitive surface 82*a* of the toner sensor 82 is wiped twice a toner replenishment cycle. This frequency of wiping has been found to be sufficient to prevent accumulation of cohered toner on the sensitive surface 82*a* so as to ensure appropriate detection of a toner level below the minimum level, which indicates the necessity for toner replenishment.

Quick transitions of the toner pan 94 between the upper and lower positions are desirable. In this regard, the arrangement of the swing member 88 disclosed is highly advantageous. The gap 104 formed between the horizontal shaft 92 and the inner edge 94*a* of the toner pan 94 facilitates the dumping of toner out of the toner pan 94. The gap 106 formed between the horizontal shaft 92 and the counterweight 96, as well as the shape of the counterweight 106, is useful to reduce or eliminate toner deposition thereon, as described above. All of these effectively contribute to quick transitions of the toner pan 94. Further, the separation of the toner pan 94 and the counter weight 96 in the longitudinal direction of the horizontal shaft 92 is also useful to avoid any harmful effects of toner deposition on the counterweight 96, which could otherwise affect the speed of transitions of the toner pan 94.

The present invention may be applied to various types of toner reservoirs having various types of toner sensors. By using the present invention, the sensitive surface of the toner sensor used may be kept clean by virtue of a wiping mechanism, which may be simple in structure and may be fabricated at low cost.

Having described the present invention with reference to the preferred embodiment thereof, it is to be understood that the present invention is not limited to the disclosed embodiment, but may be embodied in various other forms without departing from the spirit and the scope of the present invention as defined by the appended claims.

What is claimed is:

1. A toner reservoir that receives toner to be dispensed therefrom, comprising:

a toner sensor having a sensitive surface exposed to toner in the toner reservoir and detecting whether the sensitive surface is in contact with toner in the toner reservoir;

a wiper mechanism that wipes said sensitive surface of said toner sensor, said wiper mechanism comprising (i) a swing member supported for swinging motion and (ii) a wiper element mounted on said swing member such that, when said swing member produces swinging motion, said wiper element moves across said sensitive surface while rubbing said sensitive surface, said swing member being disposed in said toner reservoir so that said swing member produces swinging motion in accordance with change of an amount of toner in said toner reservoir without being driven by a power source external of the toner reservoir.

2. A toner reservoir according to claim 1, wherein:

said swing member has a swinging end on which said wiper element is mounted.

3. A toner reservoir according to claim 1, wherein:

said swing member is adapted to produce a stroke of swinging motion upon toner replenishment in said toner reservoir.

4. A toner reservoir according to claim 3, wherein:

said swing member is adapted to produce a stroke of swinging motion upon toner depletion in said toner reservoir to a certain extent.

5. A toner reservoir according to claim 1, wherein:

said toner sensor is an oscillatory sensor comprising a piezoelectric crystal element.

6. A toner reservoir according to claim 1, wherein:

said toner reservoir is adapted for toner replenishment to be conducted by allowing an amount of toner to fall down;

said swing member includes a toner pan adapted to receive a part of an amount of toner falling down upon toner replenishment;

said swing member is supported for swinging motion about a horizontal axis, such that said toner pan moves up and down between an upper position and a lower position when said swing member swings in opposite directions about said horizontal axis; and said swing member is balanced such that said toner pan is located in said upper position when toner in said toner reservoir is substantially depleted and that said toner pan makes a transition from said upper position to said lower position upon toner replenishment in said toner reservoir.

7. A toner reservoir according to claim 6, wherein:

said toner pan is further adapted to dump out any amount of toner remaining thereon when toner in said toner reservoir is depleted to a certain extent; and said swing member is further balanced such that said toner pan makes a transition from said lower position to said upper position when said toner pan dumps out toner.

8. A toner reservoir according to claim 7, wherein:

said toner pan comprises a substantially flat plate having a surface extending substantially parallel to said horizontal axis of swinging motion of said swing member;

said toner pan extends in a radial direction with respect to said horizontal axis and has a radially inner edge and a radially outer edge with respect to said horizontal axis; and said toner pan is adapted to slant upward from said radially inner edge to said radially outer edge when said toner pan is located in said upper position and downward from said radially inner edge to said radially outer edge when said toner pan is located in said lower position.

9. A toner reservoir according to claim 8, wherein:

said toner pan is further adapted to dump out any amount of toner remaining thereon from said radially inner edge when reaching said upper position.

10. A toner reservoir according to claim 7, wherein:

said swing member includes a counterweight by means of which said swing member is balanced.

11. A toner reservoir according to claim 6, wherein:

said toner sensor is disposed such that said sensitive surface extends generally vertically; and said wiper element is mounted on said toner pan so as to be movable up and down together with said toner pan.

12. A toner reservoir according to claim 6, wherein:

said toner sensor is an oscillatory sensor comprising a piezoelectric crystal element.

13. A toner reservoir according to claim 1, wherein:

said toner reservoir is adapted for toner replenishment to be conducted by allowing an amount of toner to fall down, in which a part of the amount of toner falls down in a first region in said toner reservoir before another part of the amount of toner falls down in a second region in said toner reservoir;

said swing member includes a horizontal shaft having a longitudinal axis extending horizontally, a toner pan fixedly connected to said horizontal shaft and a counterweight fixedly connected to said horizontal shaft;

said toner pan is adapted to receive a part of an amount of toner falling down upon toner replenishment;

said swing member is supported for swinging motion about a horizontal axis defined by said longitudinal axis of said horizontal shaft, such that said toner pan moves up and down between an upper position and a lower position when said swing member swings in opposite directions about said horizontal axis;

said toner pan and said counterweight are connected to said horizontal shaft on opposite sides of said horizontal shaft;

said toner pan and said counterweight are connected to said horizontal shaft at positions distant from each other in the longitudinal direction of said horizontal shaft, such that said toner pan and said counterweight are disposed in said first and second regions, respectively, in said toner reservoir; and said swing member is balanced such that said toner pan is located in said upper position when toner in said toner reservoir is substantially depleted and that said toner pan makes a transition from said upper position to said lower position upon toner replenishment in said toner reservoir.

14. A toner reservoir according to claim 13, wherein:

said toner pan is further adapted to dump out any amount of toner remaining thereon when toner in said toner reservoir is depleted to a certain extent; and said swing member is further balanced such that said toner pan makes a transition from said lower position to said upper position when said toner pan dumps out toner.

15. A toner reservoir according to claim 14, wherein:

said toner pan comprises a substantially flat plate having a surface extending substantially parallel to said horizontal axis of swinging motion of said swing member;

said toner pan extends in a radial direction with respect to said horizontal axis and has a radially inner edge and a radially outer edge with respect to said horizontal axis; and said toner pan is adapted to slant upward from said radially inner edge to said radially outer edge when said toner pan is located in said upper position and downward from said radially inner edge to said radially outer edge when said toner pan is located in said lower position.

16. A toner reservoir according to claim 15, wherein:

said toner pan is further adapted to dump out any amount of toner remaining thereon from said radially inner edge when reaching said upper position.

17. A toner reservoir according to claim 16, wherein:

said toner pan is fixedly connected to said horizontal shaft through at least one rod-like connector member, with a gap formed between said horizontal shaft and said radially inner edge of said toner pan, such that said gap allows toner to pass therethrough so as to facilitate dumping out toner from said radially inner edge of said toner pan.

18. A toner reservoir according to claim 13, wherein:

said counterweight is fixedly connected to said horizontal shaft through at least one rod-like connector member, with a gap formed between said horizontal shaft and said counterweight, such that said gap allows toner to pass therethrough so as to avoid substantial deposit of toner on said swing member at a region between said shaft and said counterweight; and said counterweight is so shaped as to avoid substantial deposit of toner thereon.

19. A toner reservoir according to claim 13, wherein:

said toner sensor is disposed such that said sensitive surface extends generally vertically; and said wiper element is mounted on said toner pan so as to be movable up and down together with said toner pan.

20. A toner reservoir according to claim 13, further comprising:

an elongated toner hopper housing extending in a horizontal direction and defining a space for reserving toner therein, said toner hopper housing having an elongated top opening extending longitudinally of said toner hopper housing;

an elongated toner cartridge having an amount of toner filled therein and adapted for detachable attachment on said toner hopper housing with the bottom thereof on the top of said toner hopper housing, said toner cartridge having an elongated bottom opening extending longitudinally of said toner cartridge;

said top opening of said toner hopper housing and said bottom opening of said toner cartridge being adapted to mate with each other when said toner cartridge is attached on said toner hopper housing so as to allow discharge of toner therethrough from said toner cartridge into said toner hopper housing;

said toner cartridge having a strip of sealing tape closing said bottom opening, said sealing tape being adapted to be removed away to open said bottom opening after said toner cartridge is attached on said toner hopper housing; and said horizontal shaft being disposed in said toner hopper housing so as to extend longitudinally of said toner hopper housing.

21. A toner reservoir according to claim 13, wherein:

said toner sensor is an oscillatory sensor comprising a piezoelectric crystal element.

22. A toner reservoir that receives toner to be dispensed therefrom, comprising:

a toner sensor having a sensitive surface exposed to toner;

a wiper mechanism for wiping said sensitive surface of said toner sensor, the wiper mechanism comprising:

a member supported to move and a wiper mounted on said member such that, when the member moves, said wiper element rubs said sensitive surface;

wherein movement of the wiper mechanism takes place in association with a change in an amount of toner in the reservoir.

23. A toner reservoir for reserving therein an amount of toner to be dispensed therefrom, comprising:

a toner sensor having a sensitive surface exposed to the amount of toner in said toner reservoir, for detecting whether said sensitive surface is in contact with the amount of toner in said toner reservoir;

a wiper mechanism for wiping said sensing said sensitive surface of said toner sensor, comprising: (I) a swing member supported for swinging motion; and (ii) a wiper element mounted on said swing member such that, when said swing member produces a stroke of swinging motion, said wiper element moves across said sensitive surface while rubbing said sensitive surface; and said swing member being so disposed in said toner reservoir as to produce a stroke of swinging motion when subjected to action of the amount of toner in said toner reservoir, without being driven by any external power source.

* * * * *